US008297922B2

(12) United States Patent
Cruickshank

(10) Patent No.: US 8,297,922 B2
(45) Date of Patent: Oct. 30, 2012

(54) IMPELLER COVER AND METHOD

(75) Inventor: Joseph O. Cruickshank, Menasha, WI (US)

(73) Assignee: Nuovo Pignone S.p.A., Florence (IT)

( * ) Notice: Subject to any disclaimer, the term of this patent is extended or adjusted under 35 U.S.C. 154(b) by 553 days.

(21) Appl. No.: 12/533,181

(22) Filed: Jul. 31, 2009

(65) Prior Publication Data

US 2011/0027080 A1 Feb. 3, 2011

(51) Int. Cl.
*F04D 29/00* (2006.01)

(52) U.S. Cl. ..... 416/1; 416/62; 416/224; 416/229 R

(58) Field of Classification Search ..... 416/62, 416/224, 241 R, 241 A, 229 R, 1, 183, 212 R, 416/248
See application file for complete search history.

(56) References Cited

U.S. PATENT DOCUMENTS 4,428,717 A * 1/1984 Catterfeld ..... 416/186 R
4,720,242 A * 1/1988 Lovisetto ..... 416/186 A
5,588,803 A * 12/1996 Vetter et al. ..... 416/186 R
6,033,183 A * 3/2000 Genster ..... 416/186 R
6,296,445 B1 * 10/2001 Chasseguet et al. ..... 416/180
6,779,992 B2 * 8/2004 Lei et al. ..... 416/198 R
6,884,037 B2 * 4/2005 Lacey et al. ..... 416/214 R
2006/0280609 A1 * 12/2006 Ranz et al. ..... 416/182
2007/0147999 A1 * 6/2007 Feher ..... 416/186 R
2012/0141261 A1 * 6/2012 Giovannetti et al. ..... 415/203

* cited by examiner

*Primary Examiner* — Edward Look
*Assistant Examiner* — Christopher R Legendre
(74) *Attorney, Agent, or Firm* — Potomac Patent Group PLLC

(57) ABSTRACT

Method and impeller cover for protecting an impeller from damage. The impeller cover includes a removable body having a first face and a second face opposing the first face, the second face being configured to match a front face of the impeller of the compressor, and further having a frontal portion covering an entire frontal portion of the impeller of the compressor, and a fixing mechanism connected to the removable body and being configured to fix the impeller cover to the impeller of the compressor. The impeller cover is disposable.

21 Claims, 9 Drawing Sheets

IMPELLER COVER AND METHOD

BACKGROUND

1. Technical Field

Embodiments of the subject matter disclosed herein generally relate to methods and systems and, more particularly, to mechanisms and techniques for protecting a device from erosion and/or material buildup.

2. Discussion of the Background

During the past years, the presence of compressors is more visible in the oil and gas industry. The compressors are used not only to extract oil and gas, but also to transport the oil and gas from the extraction point to the location of the consumer. The compressors are also used in a wide variety of petrochemical processes, as for example, generating Liquefied Natural Gas (LNG), ethylene, polyethylene, etc.

Thus, the construction and maintenance of compressors is becoming more important for these industries. While many types of compressors exist, for example, centrifugal compressors, screw compressors, axial compressors, etc., most of the compressors are facing similar problems. These problems include but are not limited to, material buildup on various components of the compressors and/or erosion of some components of the compressors.

One mechanism that causes the degradation of the compressors is fouling. Fouling is caused by the adherence of particles to airfoils and annulus surfaces of the compressor. The adherence may be caused by oil mist, water mist or other mists that may be present in the compressor. The result is a build-up of material that causes increased surface roughness and to some degree changes the shape of the airfoil. FIG. 1 shows such a material build-up on an impeller of a centrifugal compressor. FIG. 2 shows a material build-up on a discharge cone of the compressor. While the airfoil is discussed in particular, the same is true for other components of the compressor. As the contaminants are small, for example, some of them may be smaller than 2 μm, fouling is currently eliminated by cleaning.

This means that the compressor is constantly inspected and when the build-up is detected, the compressor is taken out of service. Then, the components of the compressor that experience build-up are cleaned, by either being removed from the compressor, or, if the access to the affected compressor part is open, by cleaning the component while the same remains attached to the compressor. All these operations require that the process performed by the compressor be stopped, i.e., the whole production cycle is affected by this cleaning process. This results in down production time and loss of production, which are undesired by the operator of the compressor.

Hot corrosion is another mechanism that degrades parts of the compressors. Hot corrosion is the loss of material from flow path components caused by chemical reactions between the component and certain contaminants, such as salts, mineral acids or reactive gases. The products of these chemical reactions may adhere to the components of the compressor as scale. High temperature oxidation, on the other hand, is the chemical reaction between the components metal atoms and oxygen from the surrounding hot gaseous environment. The protection through an oxide scale will in turn be reduced by any mechanical damage such as cracking or spalling, for example during thermal cycles.

Another mechanism that may damage the components of the compressor is erosion by impact. Various particles are impinging on flow surfaces of the compressor while those particles are circulated through the compressors. These particles typically have to be larger than 20 μm in diameter to cause erosion by impact. Erosion is probably more of a problem for aero engine applications, because state of the art filtration systems used for industrial applications will typically eliminate the bulk of the larger particles. Erosion can also become a problem for driven compressors or pumps where the process gas or fluid carries solid materials. Damage is often caused by large foreign objects striking the flow path components. These objects may enter the compressor with the gas stream. Pieces of carbon build-up breaking off from fuel nozzles can also cause damage to the components of the compressors.

All these processes, i.e., erosion, deposits, or damages to the airfoil change the geometric shape of the airfoil. The deterioration of the blades of these devices is accompanied by changes in exit angles and increased losses. If the blade operates at or near transonic velocities, deposits or added roughness (with the associated growth in boundary layer thickness) will also reduce the possible flow through the blade row. Thicker boundary layers on the blades and sidewalls reduce the flow capacity, especially near choking conditions. On the other hand, if the trailing edge erodes, the throat width of the blade is increased, thus allowing more flow, but with less head reduction. Except for cleaning the affected components of the compressors, there are no known efficient methods for preventing the above-noted processes.

Accordingly, it would be desirable to provide systems and methods that avoid the afore-described problems and drawbacks.

SUMMARY

According to one exemplary embodiment, there is an impeller cover for covering at least a face of an impeller of a compressor. The impeller cover includes a removable body having a first face and a second face opposing the first face, the second face being configured to match a front face of the impeller of the compressor, and further having a frontal portion covering an entire frontal portion of the impeller of the compressor; and a fixing mechanism connected to the removable body and being configured to fix the impeller cover to the impeller of the compressor. The impeller cover is disposable.

According to another exemplary embodiment, there is a compressor that includes a housing, an impeller provided on a shaft inside the housing and configured to rotate around a longitudinal axis, and an impeller cover for covering at least a face of the impeller. The impeller cover includes a removable body having first and second faces, the second face opposing the first face, the second face being configured to match a front face of the impeller, and further having a frontal portion covering an entire frontal portion of the impeller of the compressor. The impeller cover further includes a fixing mechanism connected to the removable body and being configured to fix the impeller cover to the impeller. The first face of the removable body is configured to have a profile that achieves predetermined aerodynamic characteristics while a profile of the second face of the removable body, which corresponds to the front face of the impeller, has aerodynamic characteristics less desirable than the predetermined aerodynamic characteristics, and the impeller cover is disposable.

According to still another exemplary embodiment, there is a method for protecting an impeller of a compressor from material build-up and/or erosion. The method includes covering a front face of the impeller with an impeller cover and fixing the impeller cover to the impeller.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a compressor. However, the embodiments to be discussed next are not limited to compressors, but may be applied to other systems that have components that are affected by material build-up and/or erosion.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a disposable impeller cover may be formed to cover at least a front face of an impeller of a compressor. By covering the front face of the impeller of the compressor with the impeller cover, the material build-up and/or erosion of the impeller is prevented. In case material build-up occurs on the impeller cover, the compressor may be stopped for a short time interval, the impeller cover may be removed and a new impeller cover may be fixed on the impeller of the compressor. The process of using a disposable impeller cover will save time and extend the life of the impeller.

Figure 1:
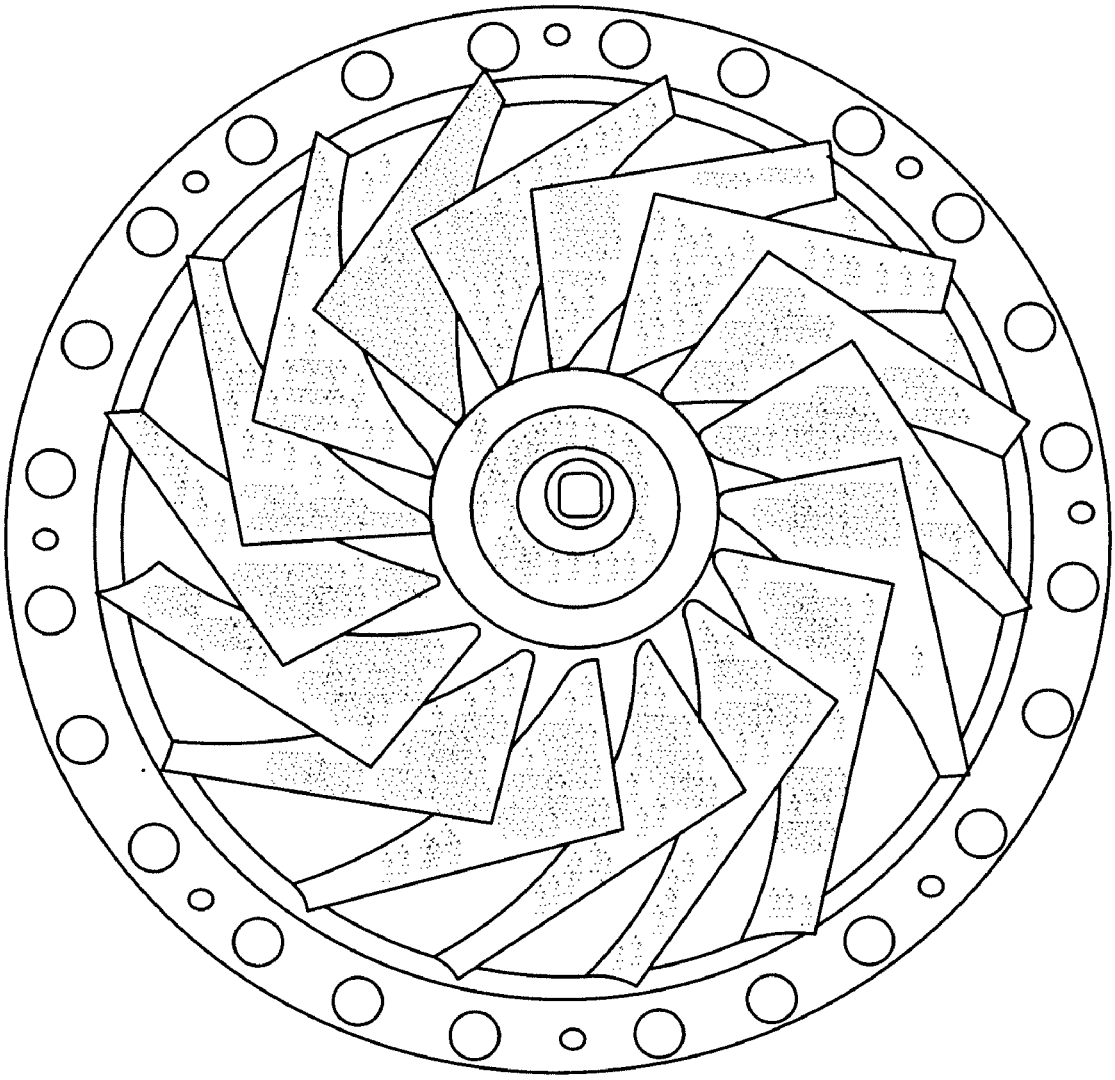
FIG. 1 Background Art
FIG. 1 is a schematic diagram of an impeller of a compressor on which material build-up is present.
Figure 2:
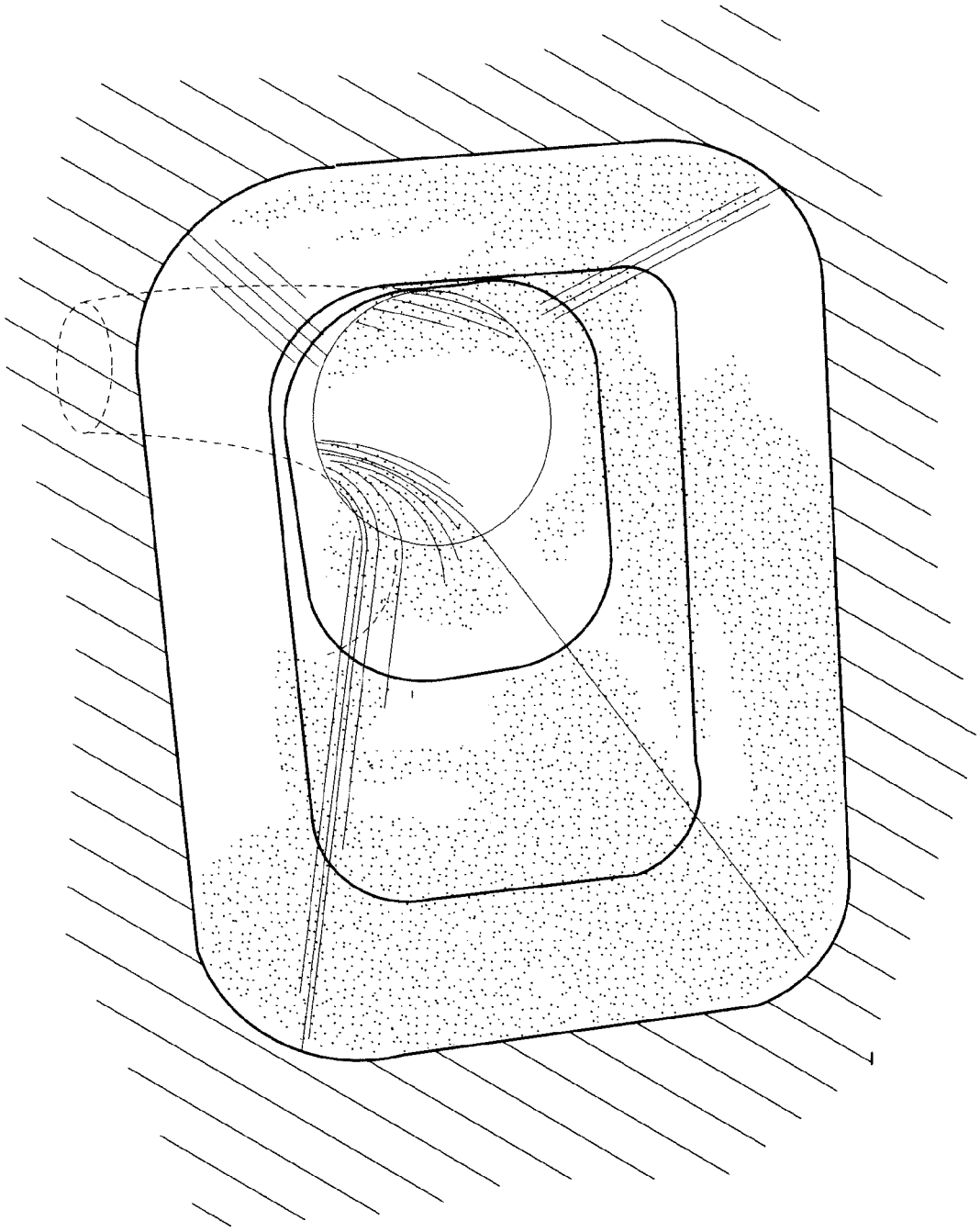
FIG. 2 Background Art
FIG. 2 is a schematic diagram of a discharge cone of a compressor on which material build-up is present.
Figure 3:
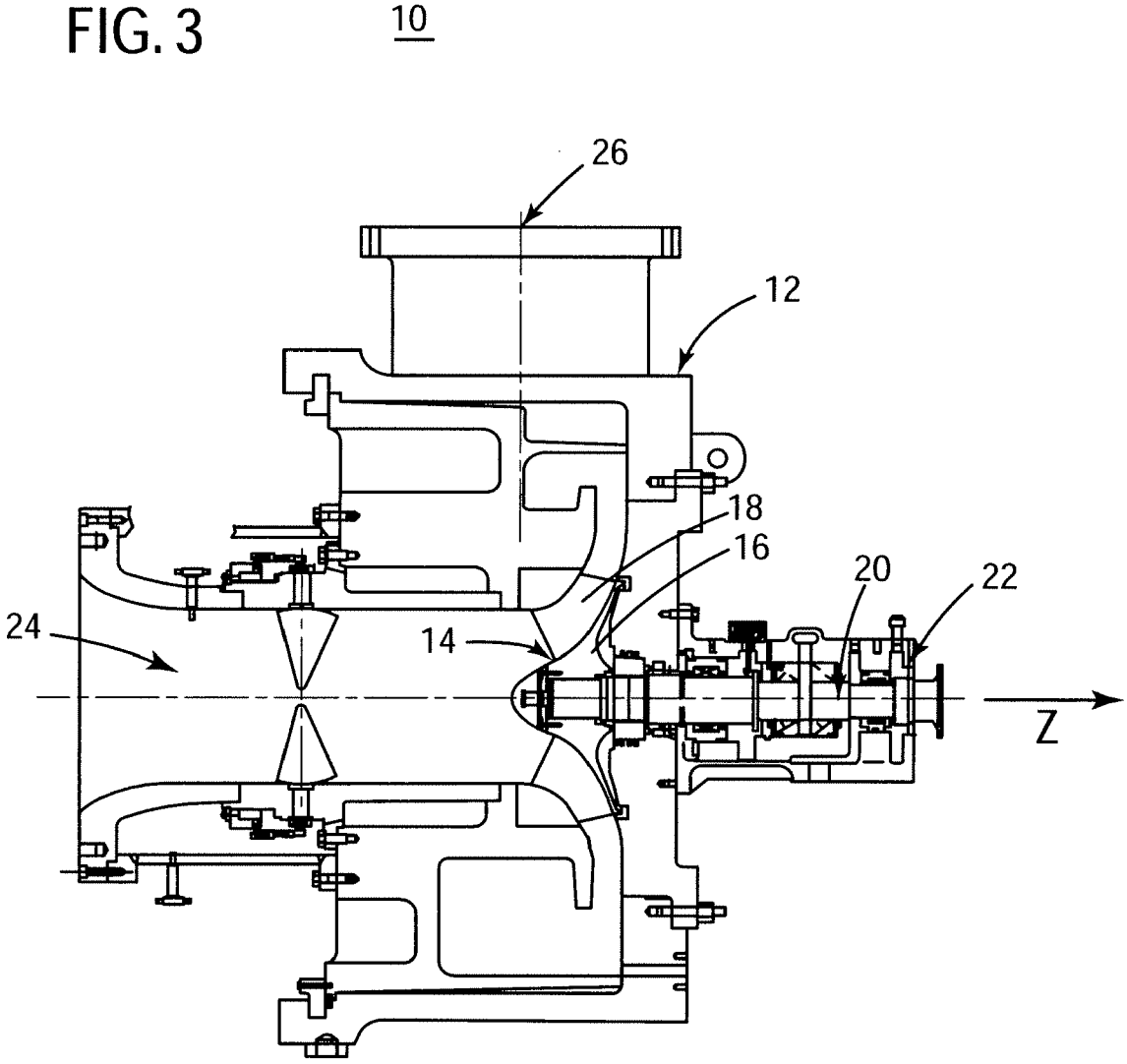
FIG. 3 is a schematic diagram of a compressor.

According to an exemplary embodiment shown in FIG. 3, a compressor 10 may include a casing 12 in which at least an impeller 14 is provided. The impeller 14 may have an impeller hub 16 to which the impeller blades 18 are formed. The impeller 14 is fixed to a shaft 20, which may rotate around a longitudinal axis Z. The shaft 20 is supporting by bearings 22. The compressor may have an inlet 24 and an outlet 26.

A fluid provided at inlet 24 is accelerated by the impeller 14 and discharged at higher pressure at outlet 26. The impeller 14 has a frontal region that directly faces the flowing fluid and a posterior region that is shielded from contact with the fluid by the frontal region. The frontal and posterior regions are illustrated for more clarity in FIG. 4. The frontal region 30 is shown having direct contact with the flowing fluid 34 while the posterior region 32 of the impeller 14 is shown not interacting with the flowing fluid 34.

Figure 4:
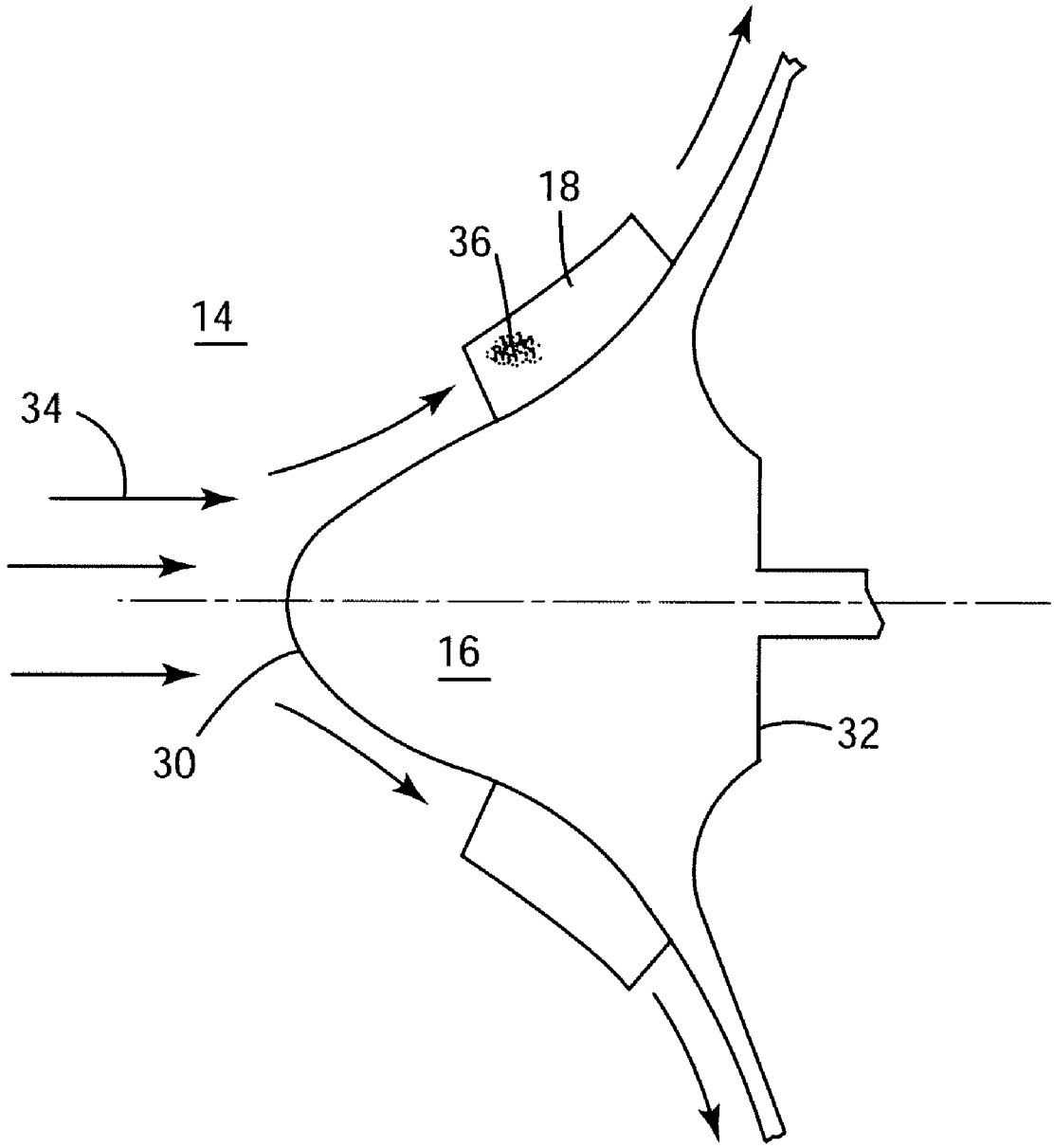
FIG. 4 is a schematic diagram of an impeller of the compressor of FIG. 3.
Figure 5:
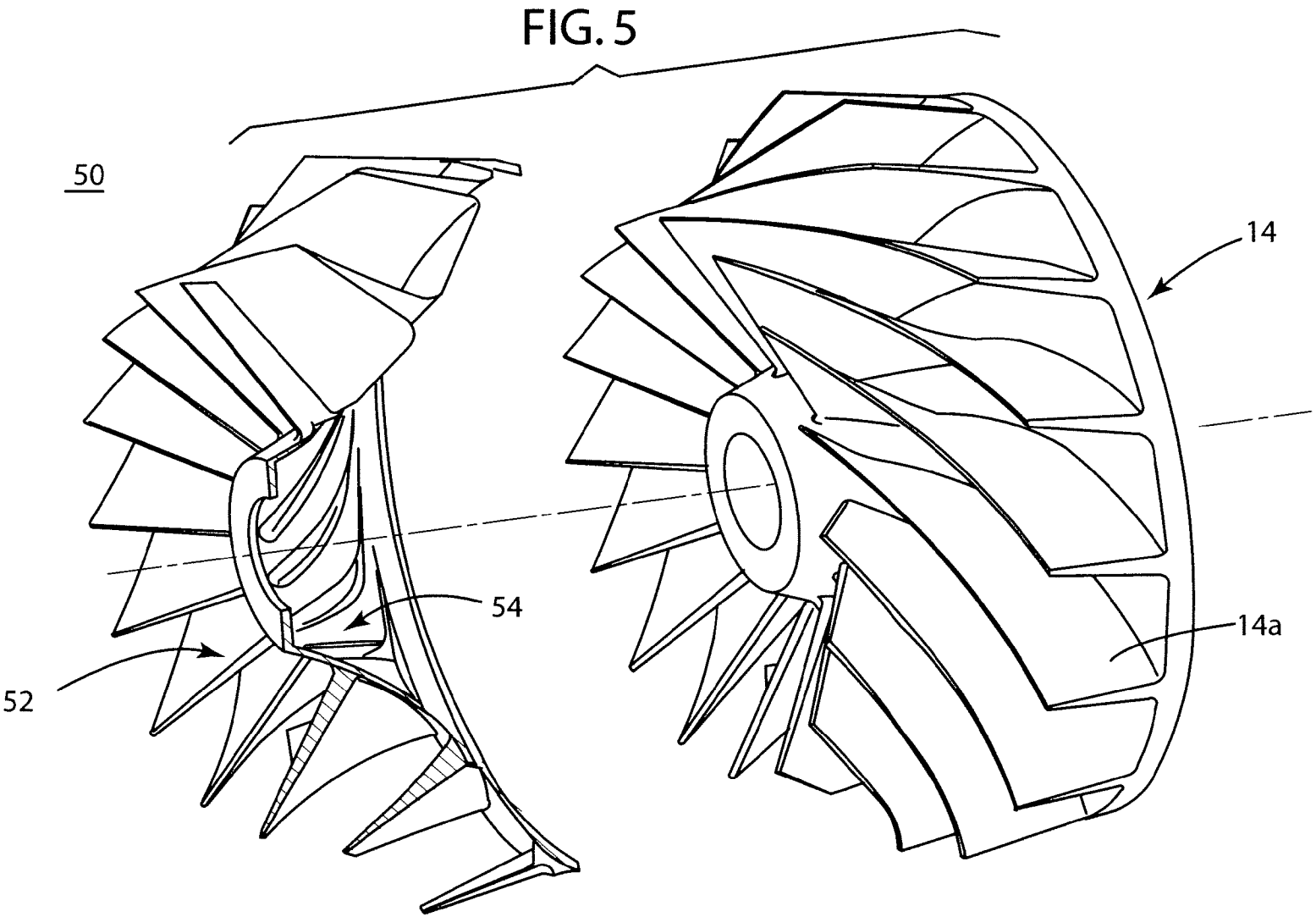
FIG. 5 is a schematic diagram of an impeller and an impeller cover according to an exemplary embodiment.

As discussed earlier, components of the fluid 34 may build up as scale 36 on the impeller 14 as shown in FIG. 4. According to an exemplary embodiment shown in FIG. 5, an impeller cover 50 may be removably attached to the impeller 14 to prevent the scale 36 and/or other damaging factors to directly affect the impeller 14. Thus, a first face 52 (frontal face) of the impeller cover is manufactured to mirror the front face 14*a* of the impeller 14. The profile of the first face 52 of the impeller 50 should be close enough to the profile of the front face 14*a* of the impeller 14 such that the aerodynamic characteristics of the impeller 14 are not degraded by the impeller cover 50. Some characteristics of the impeller 14 that should be preserved by the impeller cover 50 are the impeller (compressor) efficiency, compressor polytropic head, compressor range to stonewall (choke) and compressor range to surge. According to an exemplary embodiment, the impeller cover 50 may preserve only the impeller efficiency.

According to still another exemplary embodiment, a front face 14*a* of the impeller 14 may be machined to be different from a desired front face of a similar impeller, i.e., the front face 14*a* of the impeller 14 may be designed to not achieve the above noted characteristics. In other words, the impeller 14 may have a (faulty) front face 14*a* with undesired characteristics, which those skilled in the art would not use in a traditional compressor or turbine. However, the impeller cover 50 may be designed in such way that when covering the faulty front face 14*a*, the first face 52 of the impeller cover 50 achieves the above noted characteristics. Therefore, the impeller 14 alone does not have the desired characteristics of a good compressor but the impeller 14 together with the impeller cover 50 achieve the desired characteristics.

Figure 6:
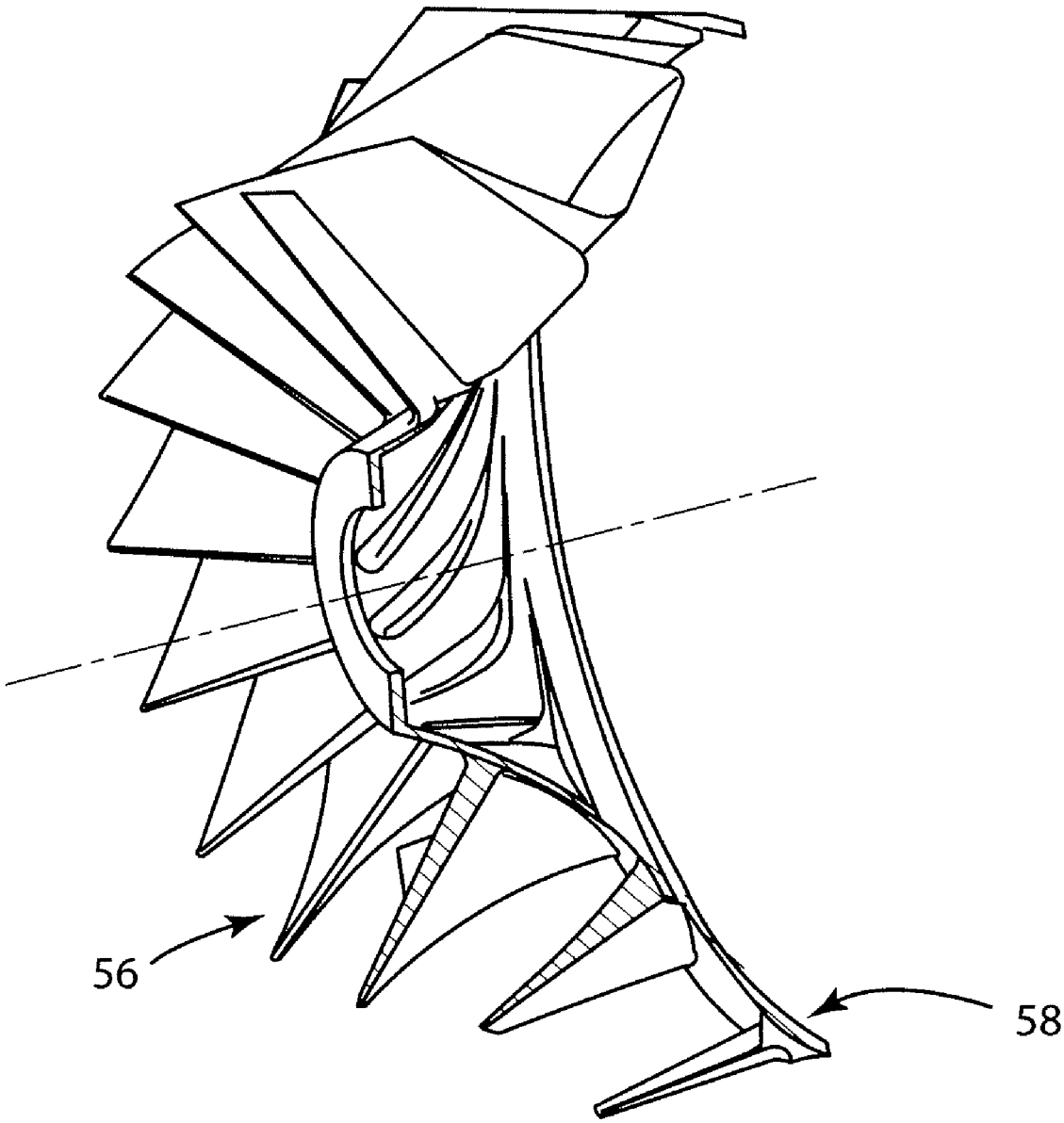
FIG. 6 is a schematic diagram of an impeller cover according to an exemplary embodiment.

According to another exemplary embodiment, a second face 54 of the impeller cover 50, which is opposite to the first face 52, should match the front face 14*a* of the impeller 14 such that the formation of air pockets between the impeller cover 50 and the impeller 14 are prevented. The impeller cover 50 may be formed out of plastic, metal, or other appropriate materials as would be recognized by one skilled in the art. In one application, the impeller cover 50 may have a first region made of one material and a second region made of a second material, different from the first material. For example, FIG. 6 shows a frontal region 56 of the impeller cover 50 and a posterior region 58 of the impeller cover 50. In this example, the frontal region 56 may be made of any plastic while the posterior region 58 may be formed of a specific plastic. In an exemplary embodiment, the specific plastic may be a stretchable plastic so that this portion may be stretched around the posterior region 32 of the impeller 14 to fix the impeller cover 50 to the impeller 14. In another exemplary embodiment, the specific plastic may be a heat shrinkable plastic that shrinks under a heat treatment. This may be used also to fix the entire impeller cover 50 to the impeller 14. In still another exemplary embodiment, the entire impeller cover 50 may be formed of the specific plastic.

Figure 7:
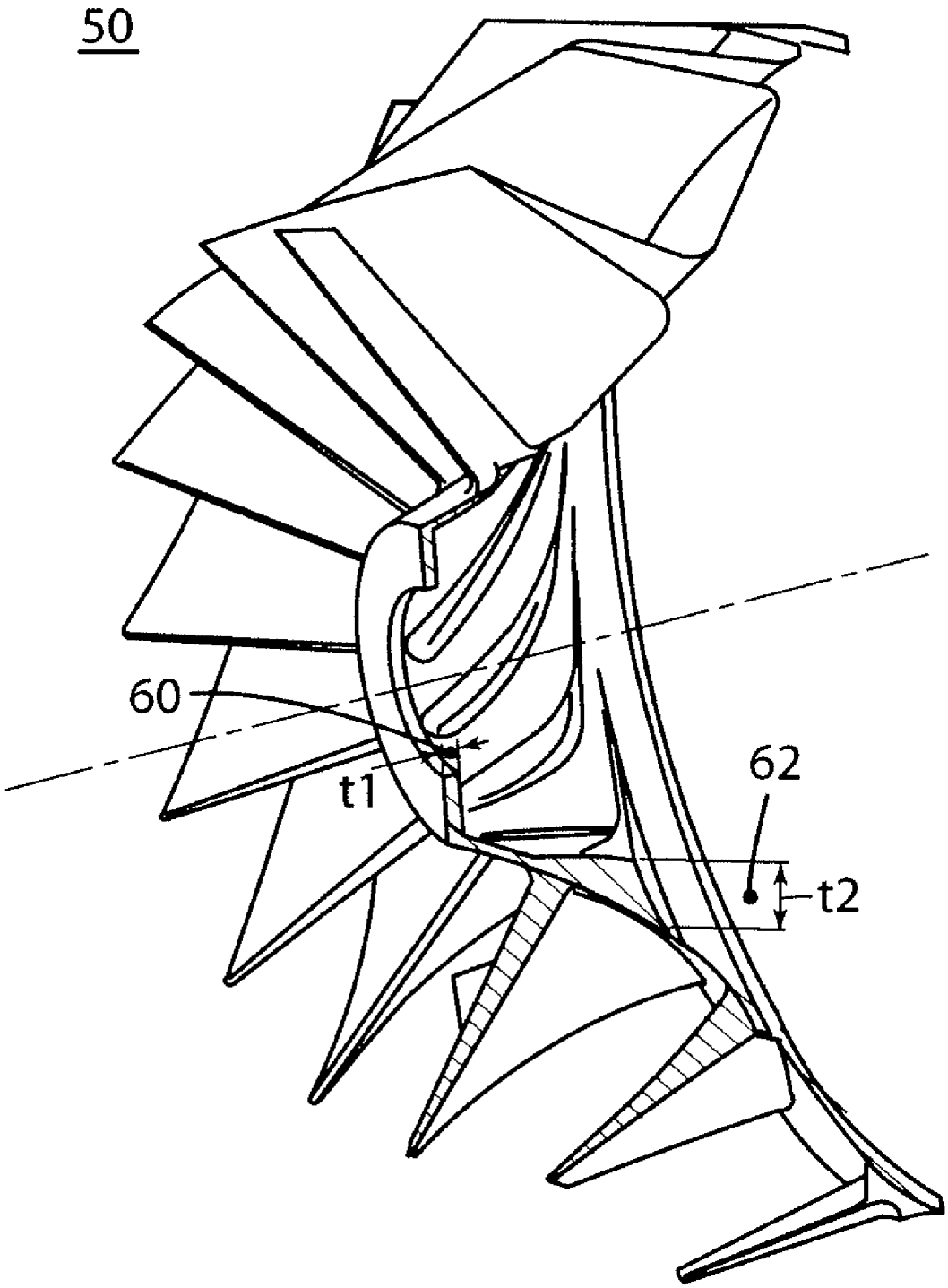
FIG. 7 is a schematic diagram of an impeller cover according to an exemplary embodiment.

According to another exemplary embodiment, a part of a body of the impeller cover 50 may have a first thickness t1 60 and another part of the body may have a second thickness t2 62, as illustrated in FIG. 7. In one exemplary embodiment, a thickness of the impeller cover 50 is uniform. Those skilled in the art would appreciate that the thickness of the impeller cover 50 depends at least on the size of the impeller and on the shape of the impeller. However, the thickness of the impeller cover 50 should be such that the first surface of the impeller cover 50 mirrors the front face 14*a* of the impeller 14.

The impeller cover 50 may include a fixing mechanism that fixes the impeller cover 50 to the impeller 14. One such mechanism has already been discussed above and it is the stretchable material attached to the body of the impeller cover 50. The stretchable material may form the posterior portion 58 of the impeller cover 50 and may extend over the posterior region 32 of the impeller 14. Another such mechanism is the heat shrinkable material discussed above and which may be used as the posterior portion 58 of the impeller cover 50. In another exemplary embodiment, the entire impeller cover 50 may be formed of a stretchable material or a heat shrinkable material.

Figure 8:
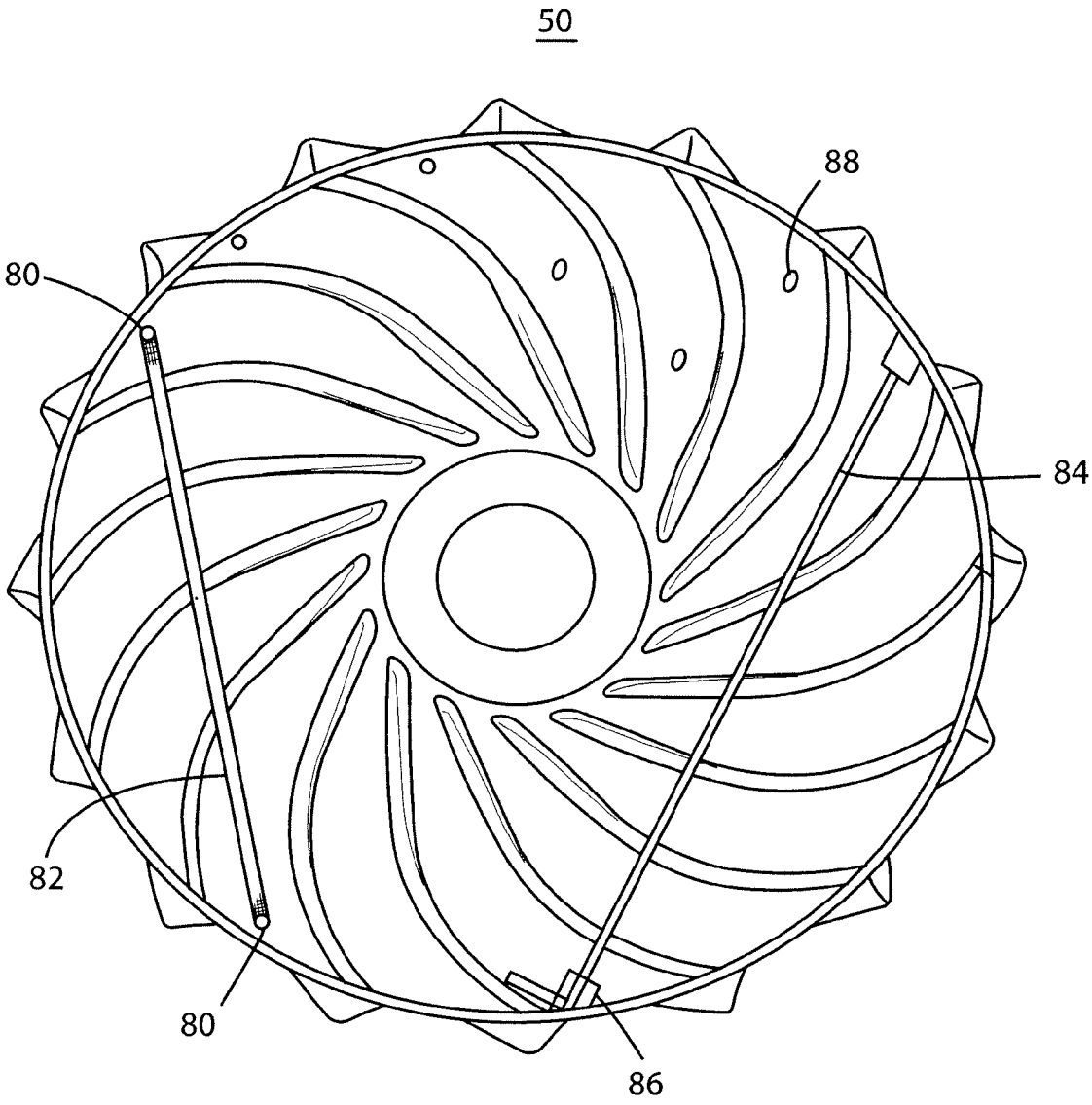
FIG. 8 is a schematic diagram of a back portion of an impeller cover according to an exemplary embodiment.

According to another exemplary embodiment, the impeller cover 50, a back view of which is shown in FIG. 8, may have holes 80 or attaching devices 84 for fixing the impeller cover 50 to the impeller 14. The holes 80 may be connected to each other by straps 82 or the attaching device 84 may be connected to a receiving part 86 for fixing the impeller cover 50 to the impeller 14. The holes 80, straps 82, attaching device 84 and receiving part 86 may be formed on the posterior portion 58 of the impeller cover 50.

According to another exemplary embodiment, pockets 88 may be formed on the second surface 54 of the impeller cover 50. The pockets 88 may be formed discretely, i.e., at given locations, or continuously, i.e., to cover the second surface 54. The pockets 88 may include a material that adheres the impeller cover to the impeller, for example, a glue-like material. Other materials that achieve a bond between the impeller cover and the impeller may be used. According to this application, when the impeller cover 50 is attached to the impeller 14, the pockets 88 stick to the front face 14*a* of the impeller 14, thus fixing the impeller cover 50 to the impeller 14. Other mechanisms for fixing the impeller cover to the impeller may be used without deviating from the scope of the embodiments as would be appreciated by those skilled in the art.

In one exemplary embodiment, the impeller cover 50 may cover only a part of the impeller 14, i.e., the front face 14*a*. In another exemplary embodiment, the impeller cover 50 may entirely cover the impeller 14, i.e., both the front face and a back face of the impeller 14. Irrespective of the percentage of impeller 14 that is covered by the impeller cover 50, the impeller cover 50 is removable (disposable) and may be changed with a new impeller cover when necessary. In one exemplary embodiment, the removal of the old impeller cover and the addition of the new impeller cover do not require any disassembly of the compressor.

Figure 9:
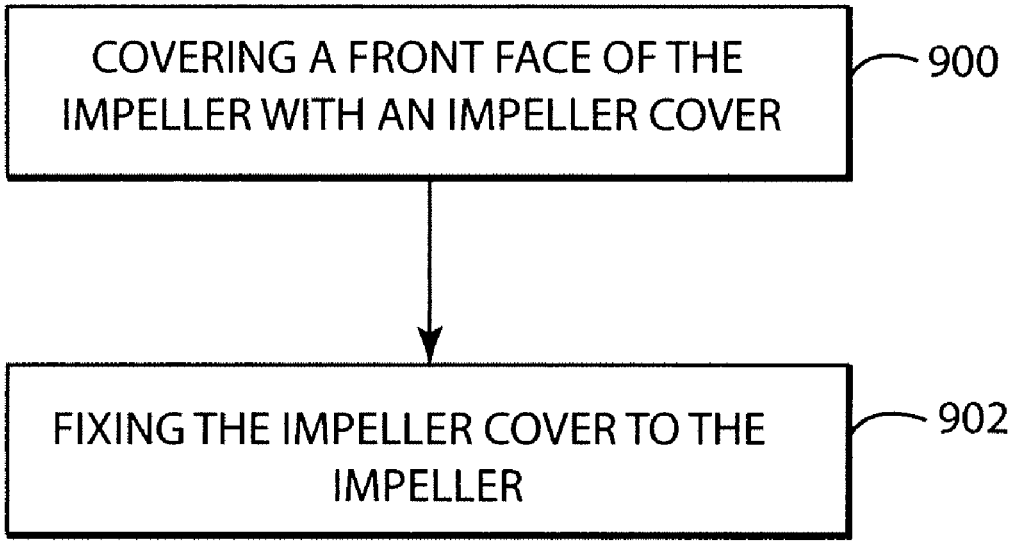
FIG. 9 is a flow chart illustrating steps of a method for protecting an impeller of a compressor according to an exemplary embodiment.

According to an exemplary embodiment there is discussed next a method for protecting an impeller of a compressor with an impeller cover. As illustrated in FIG. 9, the method includes a step 900 of covering a front face of the impeller with an impeller cover, and a step 902 of fixing the impeller cover to the impeller. The method may also include a step of removing the impeller cover and a step of adding a new impeller cover. The impeller cover may be shaped such that a frontal face of the impeller cover is configured to have a profile that achieves predetermined aerodynamic characteristics while a profile of a back face of the impeller cover, which corresponds to the front face of the impeller, has aerodynamic characteristics less desirable than the predetermined aerodynamic characteristics.

The disclosed exemplary embodiments provide an impeller cover, a compressor system and a method for protecting parts of the compressor from degradation. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. An impeller cover for covering at least a face of an impeller of a compressor, the impeller cover comprising:

a removable body having a first face and a second face opposing the first face, the second face being configured to match a front face of the impeller of the compressor such that no air pockets are formed between the removable body and the impeller, and further having a frontal portion covering an entire frontal portion of the impeller of the compressor; and a fixing mechanism connected to the removable body and being configured to fix the impeller cover to the impeller of the compressor, wherein the impeller cover is disposable.

2. The impeller cover of claim 1, wherein the removable body of the impeller cover has a posterior portion that partially covers a posterior portion of the impeller, and wherein the frontal portion of the impeller cover is configured to be directly contacted by a fluid flow through the compressor.

3. The impeller cover of claim 2, wherein the posterior portion of the removable body forms the fixing mechanism and is configured to stretchably cover, at least partially, the posterior portion of the impeller.

4. The impeller cover of claim 2, wherein the posterior portion of the impeller cover comprises holes configured to allow straps to connect the holes such that the impeller cover is fixed on the impeller of the compressor and the frontal portion of the impeller cover is free of holes.

5. The impeller cover of claim 1, wherein the first face of the removable body is configured to have a profile that achieves predetermined aerodynamic characteristics.

6. The impeller cover of claim 1, wherein the fixing mechanism comprises adherent pockets that are distributed on the second face of the impeller cover.

7. The impeller cover of claim 6, wherein the adherent pockets cover the entire second face of the impeller cover.

8. The impeller cover of claim 1, wherein the removable body is formed from plastic or metal or a combination of plastic and metal.

9. The impeller cover of claim 1, wherein the fixing mechanism comprises a material different from the removable body.

10. The impeller cover of claim 1, wherein the fixing mechanism is heat sensitive such that a heat treatment applied to the fixing mechanism tightens the fixing mechanism to fix the impeller cover to the impeller of the compressor.

11. A compressor comprising:

a housing;

an impeller provided on a shaft inside the housing and configured to rotate around a longitudinal axis; and an impeller cover for covering at least a face of the impeller, the impeller cover including, a removable body having first and second faces, the second face opposing the first face, the second face being configured to match a front face of the impeller such that no air pockets are formed between the removable body and the impeller, and further having a frontal portion covering an entire frontal portion of the impeller of the compressor, and a fixing mechanism connected to the removable body and being configured to fix the impeller cover to the impeller, wherein the first face of the removable body is configured to have a profile that achieves predetermined aerodynamic characteristics, and the impeller cover is disposable.

12. The compressor of claim 11, wherein the removable body of the impeller cover has a posterior portion that partially covers a posterior portion of the impeller, and wherein the frontal portion of the impeller cover is directly contacted by a fluid flow through the compressor.

13. The compressor of claim 12, wherein the posterior portion of the removable body forms the fixing mechanism and is configured to stretchably cover, at least partially, the posterior portion of the impeller.

14. The compressor of claim 12, wherein the posterior portion of the impeller cover comprises holes configured to allow straps to connect the holes such that the impeller cover is fixed on the impeller of the compressor and the frontal portion of the impeller cover is free of holes.

15. The compressor of claim 11, wherein the fixing mechanism comprises adherent pockets that are distributed on the second face of the impeller cover.

16. The compressor of claim 15, wherein the adherent pockets cover the entire second face of the impeller cover.

17. The compressor of claim 11, wherein the removable body is formed from plastic or metal or a combination of plastic and metal.

18. The compressor of claim 11, wherein the fixing mechanism comprises a material different from the removable body.

19. The compressor of claim 11, wherein the fixing mechanism is heat sensitive such that a heat treatment applied to the fixing mechanism tighten the fixing mechanism to fix the impeller cover to the impeller of the compressor.

20. A method for protecting an impeller of a compressor from material build-up and/or erosion, the method comprising:

covering a front face of the impeller with an impeller cover such that a frontal face of the impeller cover is configured to have a profile that achieves predetermined aerodynamic characteristics while a profile of a back face of the impeller cover corresponds to the front face of the impeller such that no air pockets are formed between the impeller cover and the impeller; and fixing the impeller cover to the impeller.

21. The method of claim 20, further comprising:

removing the impeller cover; and covering the front face of the impeller with a new impeller cover.

* * * * *